US005754993A

United States Patent [19]

Russell

[11] Patent Number: 5,754,993

[45] Date of Patent: May 26, 1998

[54] CONVERTIBLE CRIB AND TWIN BED WHEREIN THE HEADBOARD AND FOOTBOARD ARE ROTATED BY 90°

[75] Inventor: Clifford W. Russell, Denver, Colo.

[73] Assignee: Gerry Baby Products, Thornton, Colo.

[21] Appl. No.: 736,972

[22] Filed: Oct. 25, 1996

[51] Int. Cl.[6] ..... A47D 7/01; A47D 7/02

[52] U.S. Cl. ..... 5/93.2; 5/202; 5/285

[58] Field of Search ..... 5/93.2, 93.1, 2.1, 5/202, 201, 53.1, 285

[56] References Cited

U.S. PATENT DOCUMENTS

| | | | |
|---|---|---|---|
| D. 370,364 | 6/1996 | Proano et al. | D6/395 |
| D. 371,254 | 7/1996 | Proano et al. | D6/391 |
| 1,193,272 | 8/1916 | Laforest . | |
| 2,544,274 | 3/1951 | Moeller | 5/185 |
| 2,676,338 | 4/1954 | Robertson et al. | 5/202 |
| 2,677,832 | 5/1954 | Christensen | 5/93 |
| 3,100,304 | 8/1963 | Brandlin et al. | 5/202 |
| 3,383,718 | 5/1968 | Spencer | 5/100 |
| 4,450,597 | 5/1984 | Hull | 5/2 R |
| 4,525,883 | 7/1985 | Necowitz | 5/93 B |
| 5,020,172 | 6/1991 | Timm | 5/200.1 |
| 5,038,427 | 8/1991 | Golden | 5/93.2 |
| 5,077,846 | 1/1992 | Wheeler et al. | 5/93.2 |
| 5,146,631 | 9/1992 | Deal | 5/93.2 |
| 5,163,190 | 11/1992 | Hwang | 5/93.2 |
| 5,173,974 | 12/1992 | Proano et al. | 5/93.2 |

*Primary Examiner*—Alexander Grosz
*Attorney, Agent, or Firm*—Robert G. Crouch; Holland & Hart LLP

[57] ABSTRACT

An article of furniture which is convertible between a crib bed configuration and a twin bed configuration. Each configuration includes a headboard, a footboard, and a mattress frame assembly. In the crib bed configuration, the headboard and footboard are identical, each including a pair of outer vertical rail members and a central member. To convert each to the twin bed configuration, the outer vertical rail members are removed and the central member is rotated ninety degrees. The rotated members form the twin headboard and footboard. The rotated members may be re-configured to provide a higher headboard than footboard in the twin configuration. The mattress frame assembly is also re-configurable between the crib bed configuration and the twin bed configuration, by pivoting extension frame members between perpendicular and parallel positions relative to a central frame member.

15 Claims, 9 Drawing Sheets

CONVERTIBLE CRIB AND TWIN BED WHEREIN THE HEADBOARD AND FOOTBOARD ARE ROTATED BY 90°

The present invention relates to an improved design for a convertible crib and twin bed and, more particularly, to a convertible bed in which a headboard and footboard for a crib bed can be easily convertible to the headboard and footboard of a twin bed.

BACKGROUND OF THE INVENTION

Crib beds for infants conventionally include a relatively tall headboard and footboard connected by crib sides. A mattress support frame or rail is typically provided for connection at one of a variety of heights on the headboard and footboard so that the corresponding mattress height can be varied as the child grows in size, physical maturity, and ability. Such cribs are typically used for infants from birth until the two to three year age range.

After a crib, young children typically use either a youth bed or a larger twin bed. Twin beds are usable by persons ranging in size from young children to full-sized adults. Twin bed mattresses typically are seventy-four inches long while crib mattresses are typically fifty-two inches long.

Since headboards, footboards, and bed rails or bed frames for both cribs and twin beds are relatively expensive, there have been attempts to provide beds which are convertible between different bed configurations including cribs, youth beds, twins, and full-sized beds. Such convertible designs have met with varying degrees of success. One drawback of many such designs is that once the bed is converted from the crib size, it is often necessary to purchase a free-standing mattress support frame, also known as a "Hollywood" frame. In addition, many such designs convert to full-size beds and not to twin beds. Twin beds are most desirable for young children as they take up less space in what is often a smaller sized bedroom and are more than sufficient in size for use by a child.

One such design includes a headboard and a footboard for a crib which are divided vertically into separate pieces which are removably attached to each other. Several of the pieces can be removed and additional, separate pieces can be added on horizontal sides of the remaining pieces to form a twin bed headboard or footboard. In addition, a stand-alone separate twin bed frame must be purchased and attached to the headboard. Such a design suffers from the drawback that a separate twin bed frame is required, as well as the complex rearrangement of pieces required to convert between different bed configurations. In addition, it is believed that the headboard when assembled in either fashion may not be as rigid and sturdy as desired. Lastly, the large number of parts which are not common to both configurations requires these additional parts to be stored over a period of years so that they are easily retrievable when necessary to convert to another configuration.

Another such design includes a crib configuration in which the side panels of a crib are employed as a footboard and a headboard in an adult-sized configuration. Unfortunately, such a design provides a full-sized bed rather than a twin bed. In addition, this design has the disadvantage of requiring separate mattress frames for each configuration.

It is against this background, and the desire to solve the problems of the prior art, that the present invention has been developed.

SUMMARY OF THE INVENTION

Accordingly, it is an object of the present invention to provide a new and improved convertible crib and twin bed.

It is another object of this invention to provide a convertible crib and twin bed which maximizes the number of commonly used parts and minimizes the number of parts used for only one of the configurations.

It is also an object of this invention to provide a convertible bed which, when assembled in either configuration, is sufficiently rigid, sturdy, and secure.

It is further an object of this invention to provide a convertible bed which is conveniently and easily convertible between the two different configurations.

It is still further an object of this invention to provide a convertible bed which provides a pleasing and aesthetically favorable appearance in each of the two configurations.

It is yet further an object of this invention to provide a convertible bed which does not appear at first glance to be convertible, so as to present a more aesthetic appearance.

It is another object of the present invention to provide a convertible crib which is easily and economically manufactured.

It is another object of the present invention to provide a convertible crib which is easily and conveniently stored when disassembled.

Additional objects, advantages and novel features of this invention shall be set forth in part in the description that follows, and in part will become apparent to those skilled in the art upon examination of the following specification or may be learned by the practice of the invention. The objects and advantages of the invention may be realized and attained by means of the instrumentalities, combinations, and methods particularly pointed out in the appended claims.

To achieve the foregoing and other objects and in accordance with the purposes of the present invention, as embodied and broadly described therein, the present invention is directed to an article of furniture, convertible between a crib bed configuration which is adapted to receive and support a crib mattress and a twin bed configuration which is adapted to receive and support a twin mattress. The article of furniture includes a headboard, a footboard, and a pair of bed frame assemblies attachable between the headboard and footboard for supporting the mattress. Each of the headboard and the footboard include an elongated central member, a first pair of elongated rails, opposite ones of the first pair being attached to opposite ends of the central member, and a second pair of elongated rails, opposite ones of the second pair being removably attached to opposite ends of the first pair of rails. When assembled in this manner and with the first pair of rails oriented horizontally and the second pair of rails oriented vertically, the headboard and the footboard are in the crib configuration. In addition, the longest dimension of the central member is sufficient to allow the second pair of rails on the headboard and the footboard to be removed and the central member and the first pair of rails to be rotated ninety degrees so that the first pair of rails is oriented vertically to place the headboard and the footboard in the twin configuration.

Each bed frame assembly may include an elongated central frame member and a pair of extension frame members, one disposed at either end of the central frame member, each extension frame member being pivotably attached at an end thereof to the end of the central frame member to allow each extension frame member to be pivoted between a position where the extension frame member is perpendicular to the central frame member and a position where the extension frame member is parallel to and aligned with the central frame member. In addition, when each of the extension frame members is pivoted to the perpendicular position, the effective length of the bed frame assemblies is approximately equal to the length of the crib mattress and when each of the extension frame members is pivoted to the parallel position, the effective length of the bed frame assemblies is approximately equal to the length of the twin mattress.

Each bed frame assembly may include a pair of tabs affixed thereto, one associated with each of the pivotable connections of the extension frame members to the central frame member so that the tabs can selectively be used to hold the extension frame member in the parallel position. The tabs can be used to attach the bed frame assemblies to the headboard and footboard when the extension frame members are in the perpendicular position. The article of furniture further may include a pair of connector frame members to attach the pair of bed frame assemblies together in the crib configuration.

The first set of rails on the headboard and footboard may be removably attached to the central member to allow the first set of rails to be removed from the central member and re-installed at a different position on the first set of rails of the headboard and the footboard. The headboard and footboard in the crib configuration also each may include a horizontally-disposed decorative rail attached between upper ends of the second pair of rail members in the crib configuration. Each of the decorative rails may include two separate members, a longer member and a shorter member, removably attached end to end to each other, and further wherein the longer member from each of the decorative rails can be attached together and employed as a decorative rail in the twin configuration. The article of furniture further may include a pair of extended rail members for use in the twin configuration to be connected to the ends of the first pair of elongated rails of the headboard of the twin configuration, so as to effectively lengthen the first pair of rails. The central member of the headboard can be attached to the lengthened first pair of rails of the headboard at a location higher than the attachment of the central member of the footboard to the first pair of rails of the footboard.

The central member may include a pair of elongated rails attached together by spaced apart slats. The first pair and second pair of rails each may include a plurality of bores defined therethrough to receive one of a plurality of bolts for attaching the first pair of rails to the central member and the second pair of rails to the first pair of rails. The central member and the first pair of rails include a plurality of openings defined therein to receive one of a plurality of threaded inserts which can selectively matingly engage with one of the plurality of bolts.

The present invention is also directed to a method for converting an article of furniture from a crib bed configuration to a twin bed configuration, the article of furniture including a headboard and a footboard, which are connectable to bed frame rails. The method includes the steps of removing the bed frame rails from the headboard and footboard, rotating the headboard and the footboard ninety degrees, and attaching bed frame rails to the rotated headboard and footboard.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention. In the Drawings

DETAILED DESCRIPTION OF THE PREFERRED EMBODIMENTS

Figure 1:
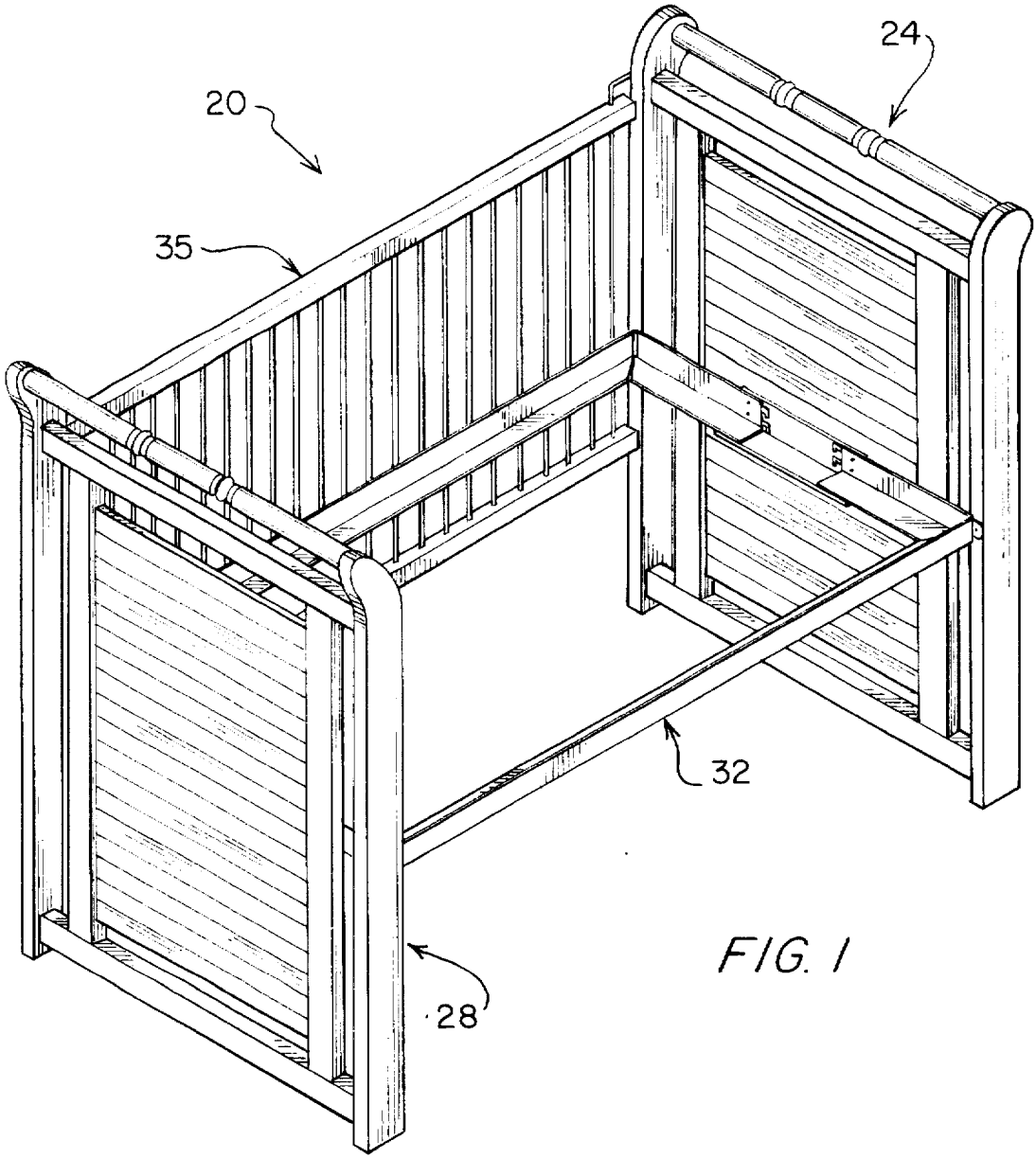
FIG. 1 is a perspective view of a convertible crib and twin bed of the present invention showing a headboard, a footboard, and a mattress frame assembly, all in a crib bed configuration, with a single crib side, the opposite crib side removed for better appreciation of the invention.
Figure 10:
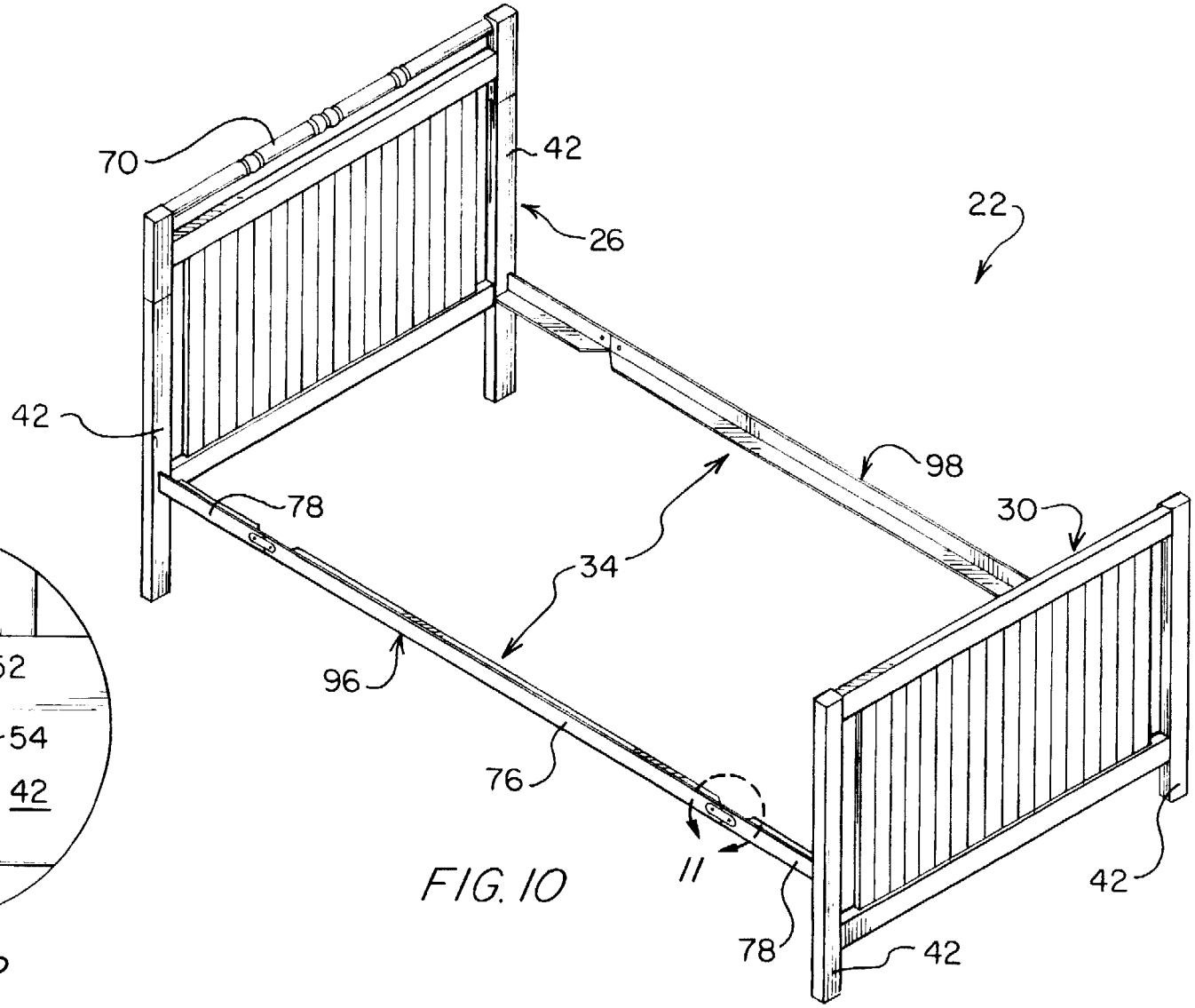
FIG. 10 is a perspective view of an assembled headboard, footboard, and mattress frame assembly of the present invention, shown in the twin bed configuration.

An article of furniture which is a convertible crib and twin bed of the present invention includes a crib bed configuration 20 of a headboard\footboard\mattress frame assembly as shown in FIG. 1. The crib bed configuration 20 is convertible to a twin bed configuration 22 of a headboard\footboard\mattress frame assembly as shown in FIG. 10. Each configuration 20 and 22 includes a headboard 24 (26) (reference numbers for the corresponding parts in the twin bed configuration 22 are provided in parentheses), a footboard 28 (30), and a mattress frame assembly 32 (34). In the crib bed configuration 20, the headboard 24 and the footboard 28 are identical. To convert the crib bed configuration 20 to the twin bed configuration 22, the headboard 24 and footboard 28 are partially disassembled, rearranged, and reassembled to form the twin headboard 26 and twin footboard 30. In the twin bed configuration 22, the headboard 26 and footboard 30 are different. The crib mattress frame assembly 32 is converted to the twin mattress frame assembly 34 by disconnecting the mattress frame assembly 32 from the headboard 24 and footboard 28, partially disassembling it, re-configuring it, and reassembling it to form the mattress frame assembly 34 which can then be connected to headboard 26 and footboard 30.

The fully assembled crib bed configuration 20 is shown in FIG. 1, with the headboard 24, the footboard 28, the mattress frame assembly 32, and a conventional crib side 35. Of course, to provide a crib for an infant (not shown) to actually use, it would first be necessary to attach a second crib side (not shown) to the crib bed configuration 20. Typically, these crib sides are connected at either end thereof to the headboard and footboard and are often selectively slidable relative to the headboard and footboard to allow the side to be lowered so as to more easily allow the infant to be placed in and out of the crib. Typically, these crib sides are provided with a plurality of vertical slat members. It also is necessary to provide a mattress (not shown) which is received within the mattress frame assembly 32. Typically, mattresses for cribs are provided in the conventional size of fifty-two inches in length and twenty-seven inches in width. The mattress would typically be supported in the mattress frame assembly 32 by a mattress support (not shown) attached to the assembly 32. Examples of such supports may include any conventional means, or other means such as a wire mesh, a fabric sheet with grommets attached to the assembly 32 by springs, or a fabric sheet with sleeves defined therein to slidably receive all or portions of the assembly 32.

Figure 2:
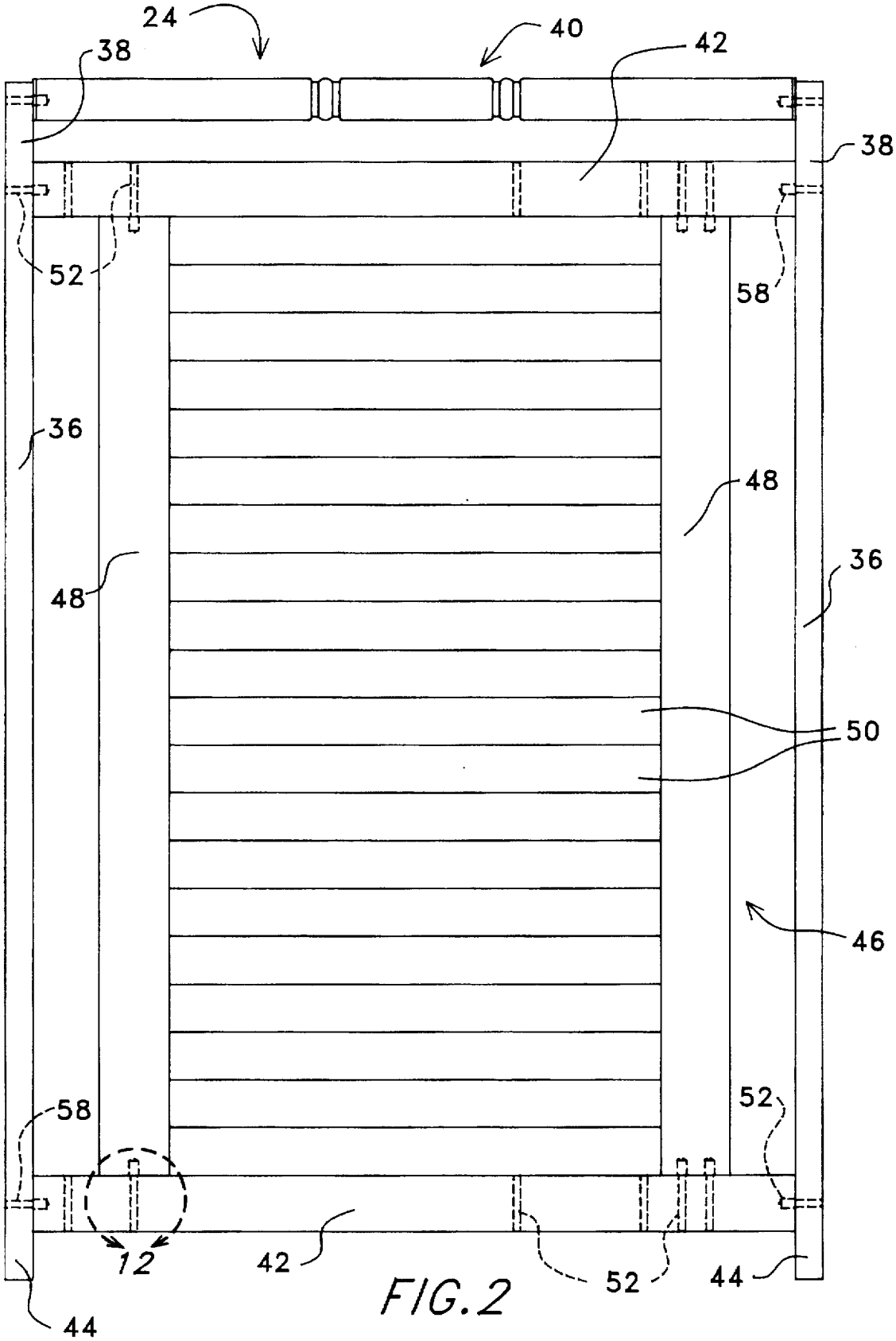
FIG. 2 is an enlarged front view of the headboard of FIG. 1.

The crib headboard 24 is shown in FIG. 2 (because of the identical nature of the crib footboard 28 to the crib headboard 24, the crib footboard 28 is not described separately). The crib headboard 24 includes a pair of elongated vertical rail members 36 which are bowed slightly at top ends 38 thereof where a two-part decorative rail 40 is connected between the top ends 38 of the rail members 36. Also connected between the vertical rail members 36 are a pair of vertically-spaced-apart horizontal rail members 42. An uppermost of the horizontal rail members is parallel to and near the decorative rail 40. The lowermost of the horizontal rail members 42 is connected between the vertical rail members 36 near lower ends 44 of the vertical rail members 36. A central panel member 46 is disposed and connected between the horizontal rail members 42. The central panel member 46 includes a pair of elongated rails 48 which are oriented vertically when the central panel member 46 is being employed in the crib headboard 24. A plurality of slats 50 are attached at either ends thereof to the elongated rails 48 of the central panel member 46 and received within corresponding mortises.

Figure 12:
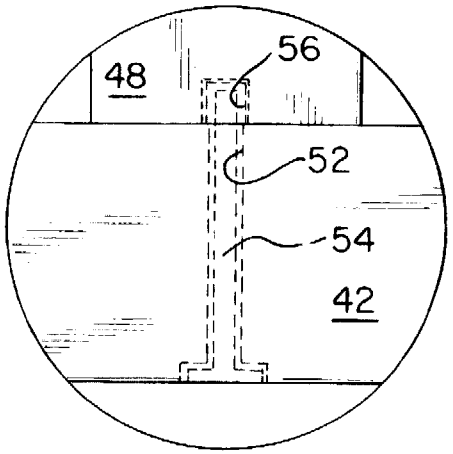
FIG. 12 is a close-up view of a bolt, a bore, and a threaded insert in the headboard of FIG. 2.

As can be seen in FIGS. 2 and 12, each of the vertical rail members 36 and the horizontal rail members 42 include a plurality of cylindrical bores 52 defined transversely therethrough which are employed to receive attachment hardware such as bolts 54 and threaded inserts 56. Additionally, the horizontal rail members 42 include longitudinally-disposed openings in ends thereof to receive the threaded inserts 56. Also, the elongated rails 48 of the central panel member 46 include longitudinally-disposed openings defined therein to receive the threaded inserts 56. As can be seen in FIG. 2, bolts 54 extend through each of the bores 52 in the vertical rail members 36 and are received in the threaded inserts 56 provided in the openings 58 in the ends of the horizontal rail members 42.

To begin the process of converting the headboard 24 and footboard 28 of the crib bed configuration 20 to the headboard 26 and footboard 30 of the twin bed configuration 22, the bolts 54 connecting the vertical rail members 36 to the ends of the horizontal rail members 42 are removed and then the vertical rail members are removed (FIG. 3) and stored for use in the future when it is desired to return to the crib bed configuration 20. The two-part decorative rail 40 is removed from the vertical rail members 36 and can be disassembled into a shorter portion 60 and a longer portion 62 thereof. The two portions 60 and 62 may be connectable together by mating male and female threaded ends, in the fashion of a two-part pool cue. These initial steps of the process of converting are common to the re-configuring to create both the twin headboard 26 and twin footboard 30.

Figure 3:
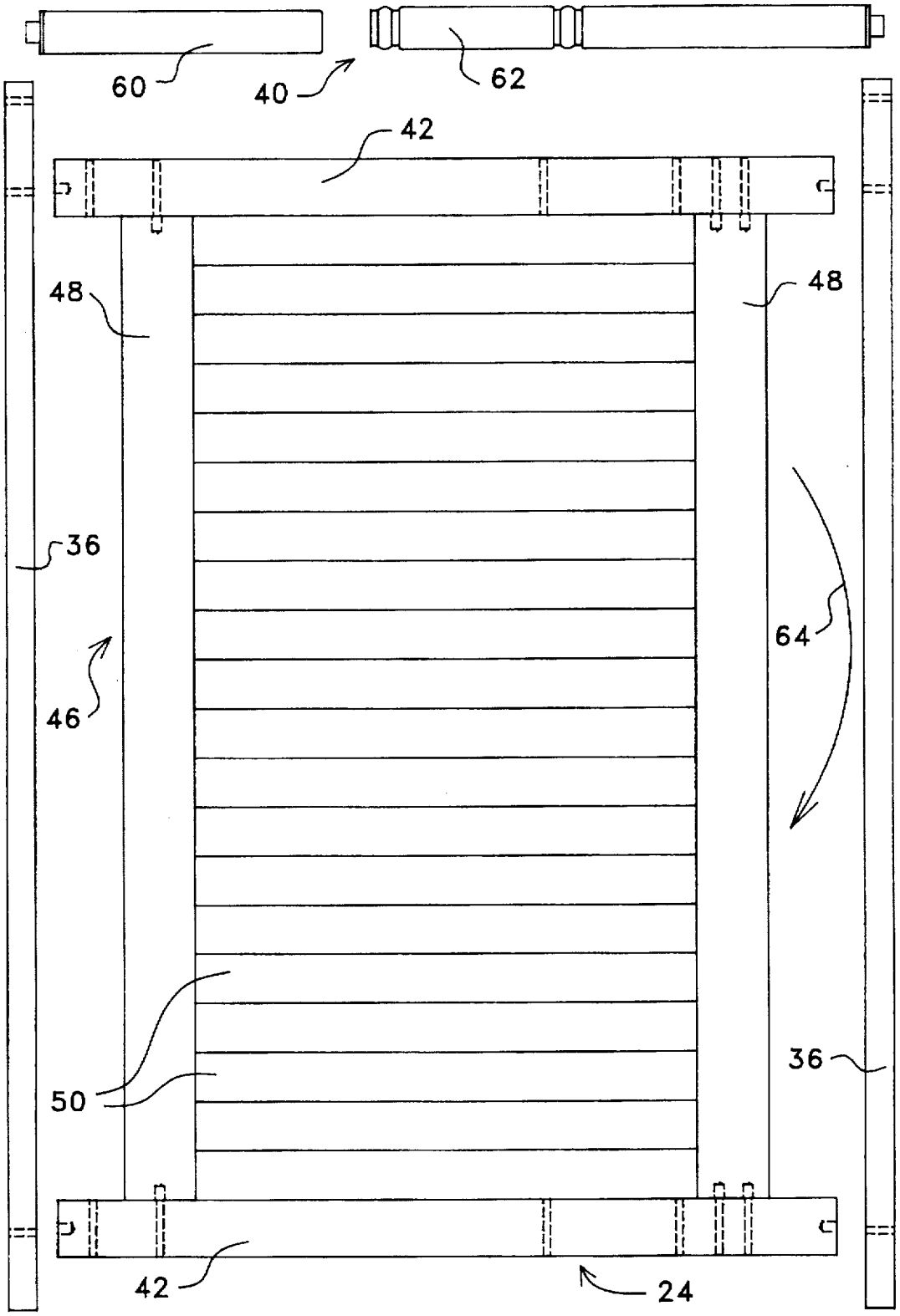
FIG. 3 is a partially exploded view of the headboard of FIG. 1.
Figure 4:
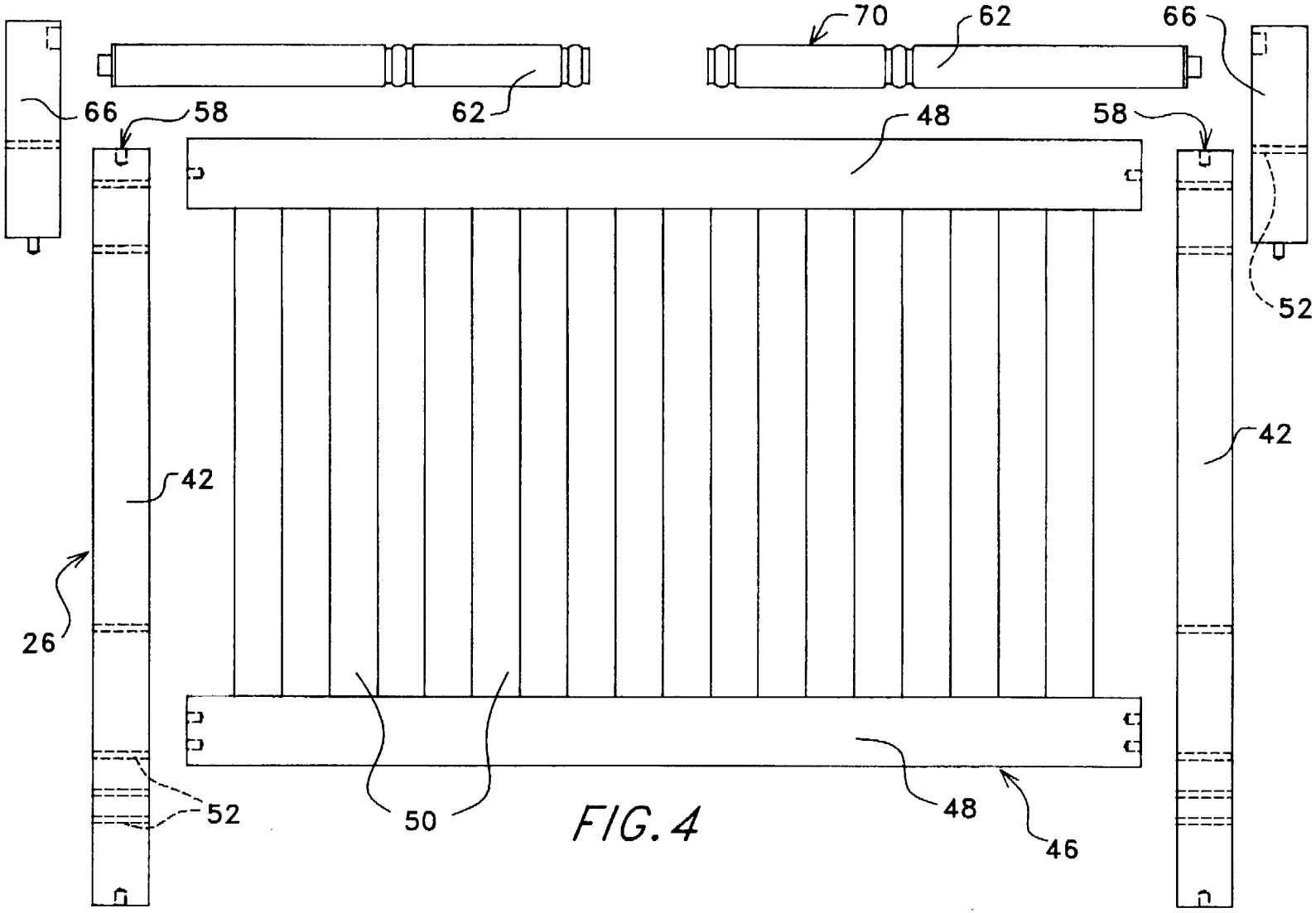
FIG. 4 is partially exploded view of a headboard for a twin bed configuration of the present invention, assembled from components of the headboard and footboard of FIG. 1.
Figure 5:
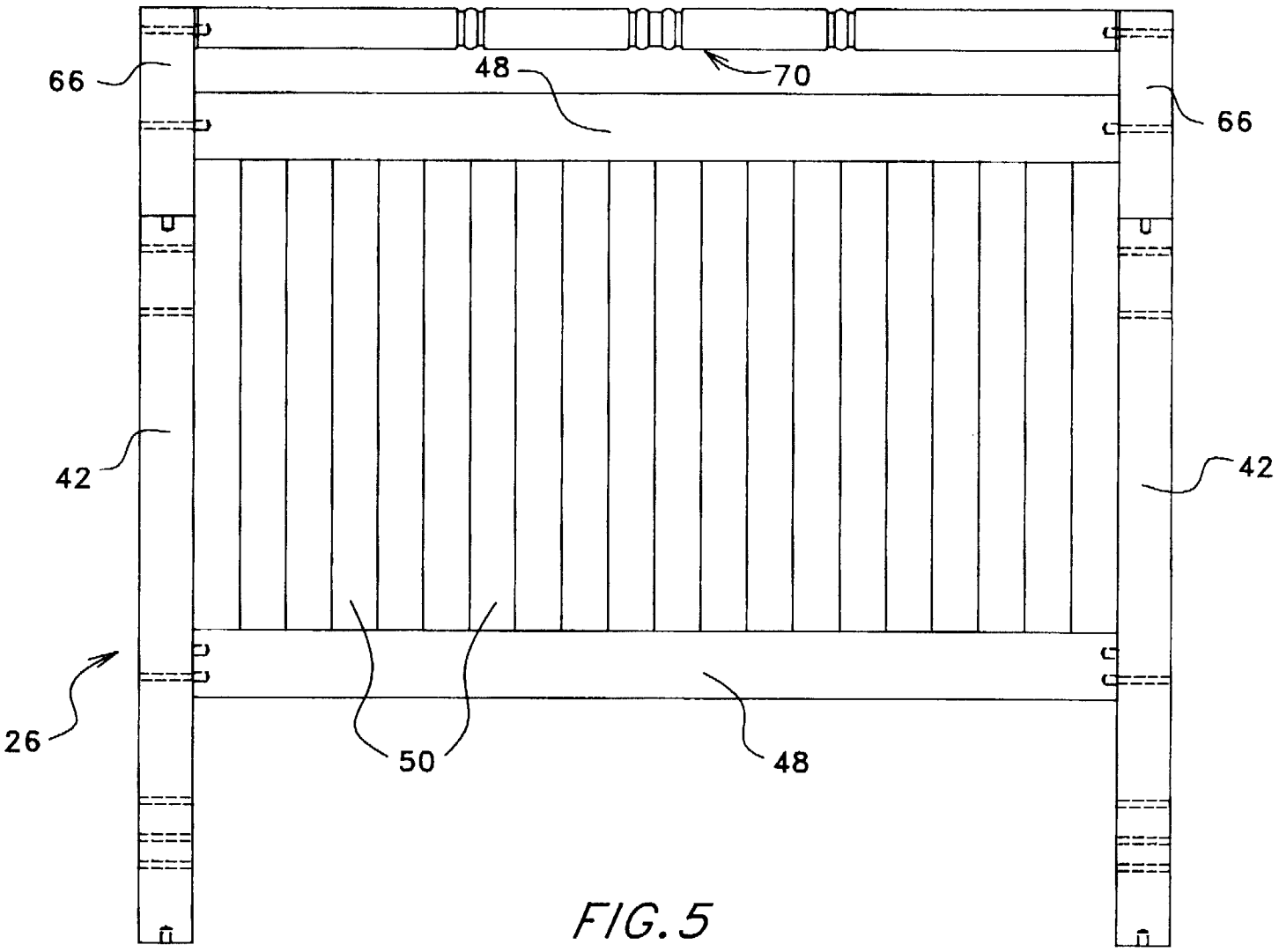
FIG. 5 is an assembled front view of the headboard of FIG. 4.

As shown in FIG. 4, the assembly of the twin headboard 26 includes components from both the crib headboard 24, the crib footboard 28, and extra components. The combination of the central panel member 46 and the horizontal member 42 from the crib headboard 24 (FIG. 3) have been rotated clockwise ninety degrees in the direction of the arrow 64 of FIG. 3 to provide the orientation shown in FIG. 4. FIG. 4 shows the next step in the conversion process, in which the horizontal rail members 42 (which are now vertically disposed) have been removed from the central panel member 46 by removing the bolts 54 shown in FIG. 3. As can be seen in FIG. 4, the longer portion 62 of the decorative rail 40 from each of the crib headboard 24 and the crib footboard 28 are used in the twin headboard 26. In addition, a pair of rail extension members 66 are brought out of storage to use in the twin headboard 26. As can be appreciated by comparing FIG. 5 to FIG. 4, each of the rail extension members 66 is insertably attached to ends of the upper ends of the rail members 42 to form an extended rail member 68. The two longer portions 62 of the decorative rails 40 are insertably connected together and connected between upper ends of the extended rail members 68. As can be appreciated, due to the joining together of the two longer portions 62 of the decorative rails 40, a significantly longer decorative rail 70 for the twin headboard 26 is created. The central panel member 46 is connected between the extended rail members 68 at a position which is offset from and higher than the position at which the central panel member 46 was connected to the rail members 42 in the crib headboard 24 (FIGS. 2 and 3). Bolts 54 and threaded inserts 56 are again used to connect the extended rail members 68 to the central panel member 46. In this fashion, the twin headboard 26 (shown in FIGS. 5 and 11) is created.

Figure 6:
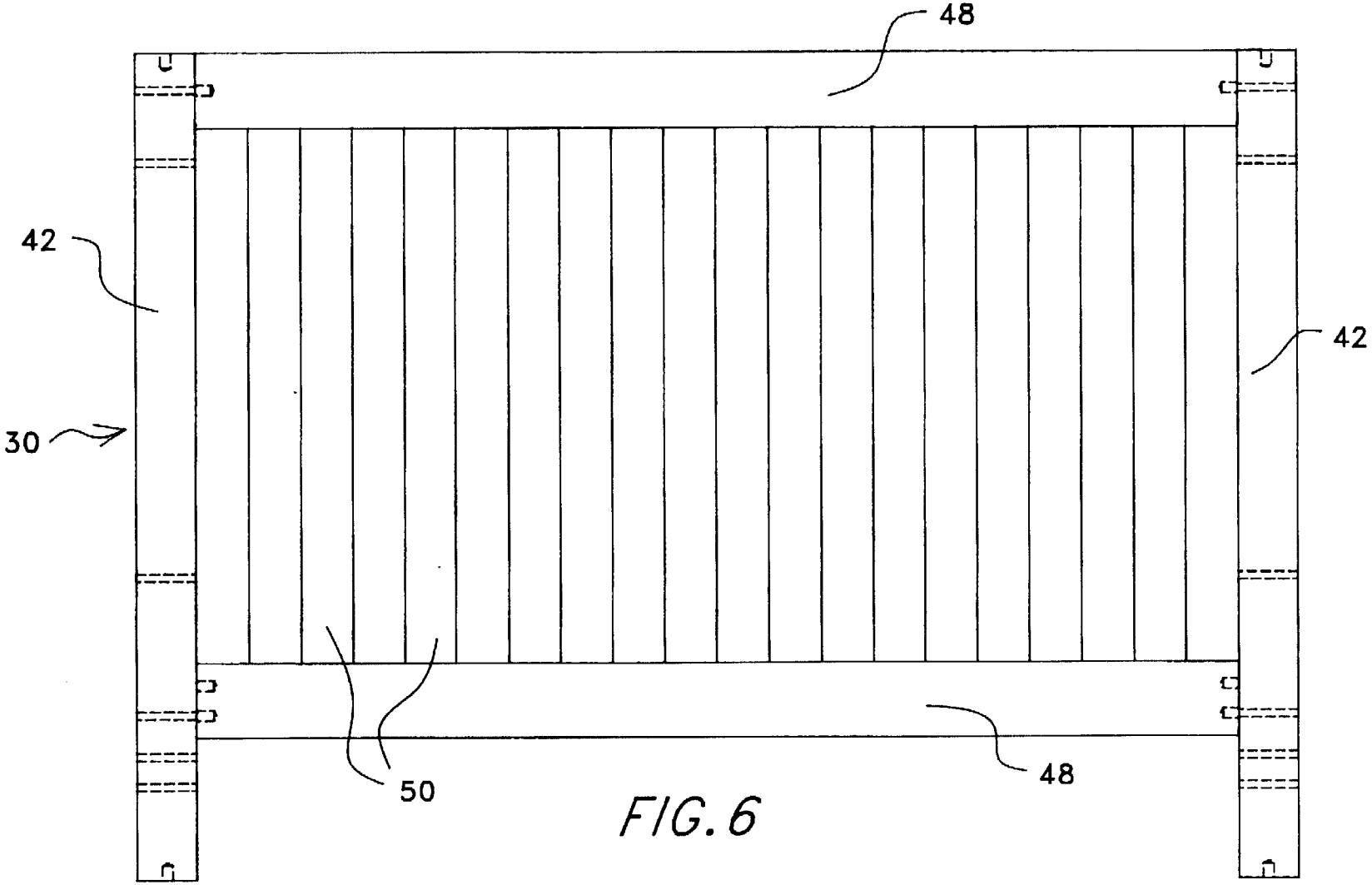
FIG. 6 is an assembled front view of a footboard in the twin bed configuration, assembled from the footboard of FIG. 1.
Figures 9, 11:
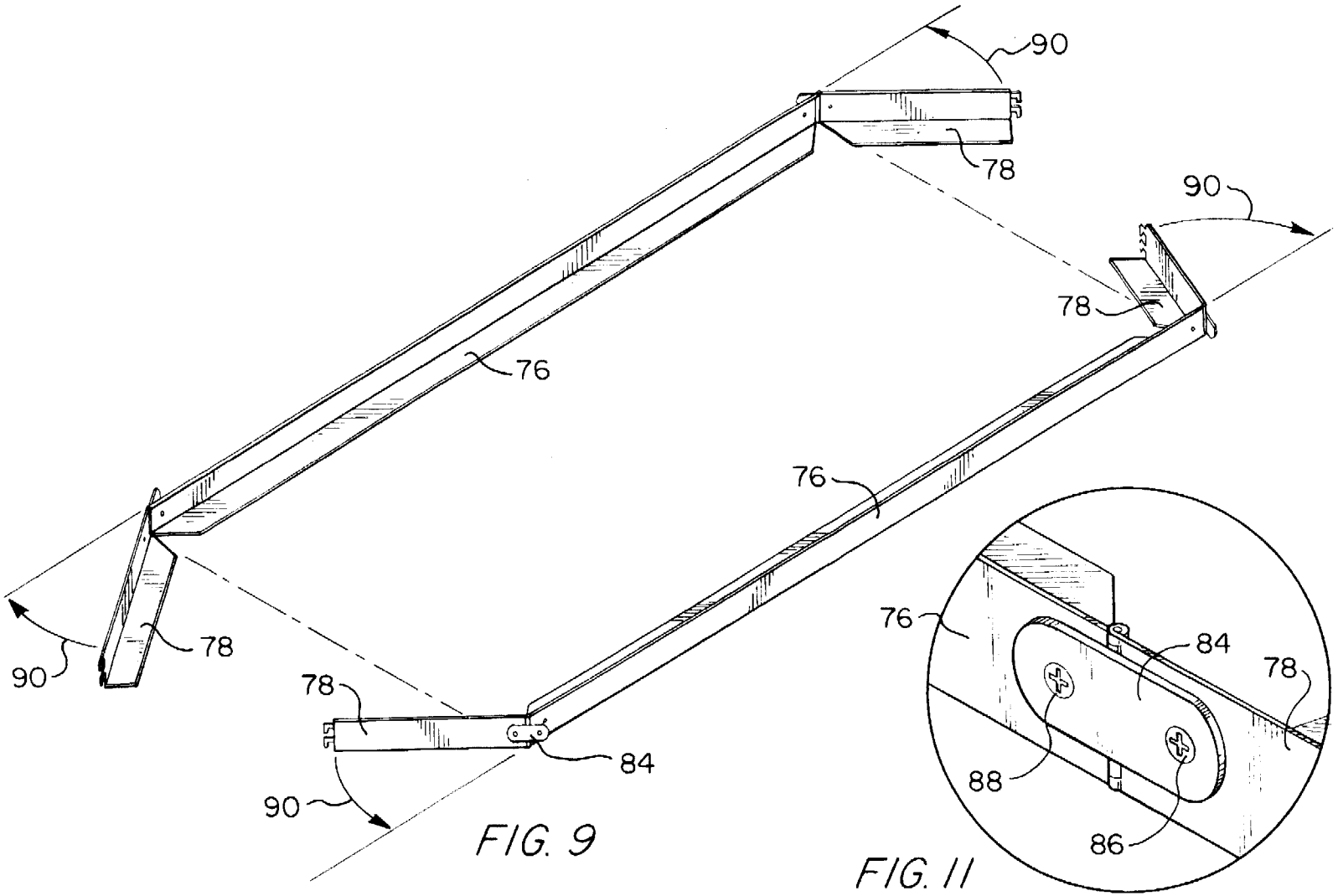
FIG. 9 is a perspective view of the mattress frame assembly of FIG. 1, shown in a position where extension frame members thereon are being pivoted toward a parallel position to achieve a twin bed configuration for the mattress frame assembly.
FIG. 11 is a close-up view of a pivot point of the mattress frame assembly of FIG. 10, the view being substantially taken of the area bounded by line 11 of FIG. 10, showing one of the extension frame members in a parallel position relative to a central frame member.

To appreciate the conversion of the crib footboard 28 (which is identical to the crib headboard 24 shown in FIGS. 2 and 3) to the twin footboard 30 (shown in FIG. 6), reference may be best made to FIG. 3. In a similar fashion to the conversion of the crib headboard 24 to the twin headboard 26, the vertical rail members 36 are removed and stored away, and the decorative rail 40 is removed with the longer portion being used in the decorative rail 70 of the twin headboard 26. In a similar fashion to the rail members 36, the shorter portion 60 of each of the decorative rails 40 are stored away for subsequent use when it is desired to re-convert to the crib configuration. The combination of the horizontal rail members 42 and central panel member 46 is also rotated ninety degrees in a clockwise direction as represented by the arrow 64 in FIG. 3 to reach the approximate configuration shown in FIG. 6. However, to reach the exact configuration of FIG. 6, it is necessary to remove the horizontal rail members 42 (which are now vertically disposed) from the central panel member 46 by removing bolts 54 therefrom. The central panel member 46 is repositioned upward until the uppermost elongated rail 48 thereof is substantially aligned with upper ends of the rail members 42. The central panel member 46 is then reattached to the rail members 42 by the bolts 54 in this new configuration. In this manner, the twin footboard 30 of FIG. 6 and 11 is created. As can be appreciated by comparing FIG. 5 to FIG. 6, and by close examination of FIG. 11, the central panel member 46 in the twin headboard 26 is relatively further from the bottom ends of the rail members 42 (or the floor) than is the central panel member 46 of the twin footboard 30. This allows for a pronounced higher and more dramatic effect for the headboard 26 than the footboard 30 in the twin bed configuration 22.

Figures 7, 8:
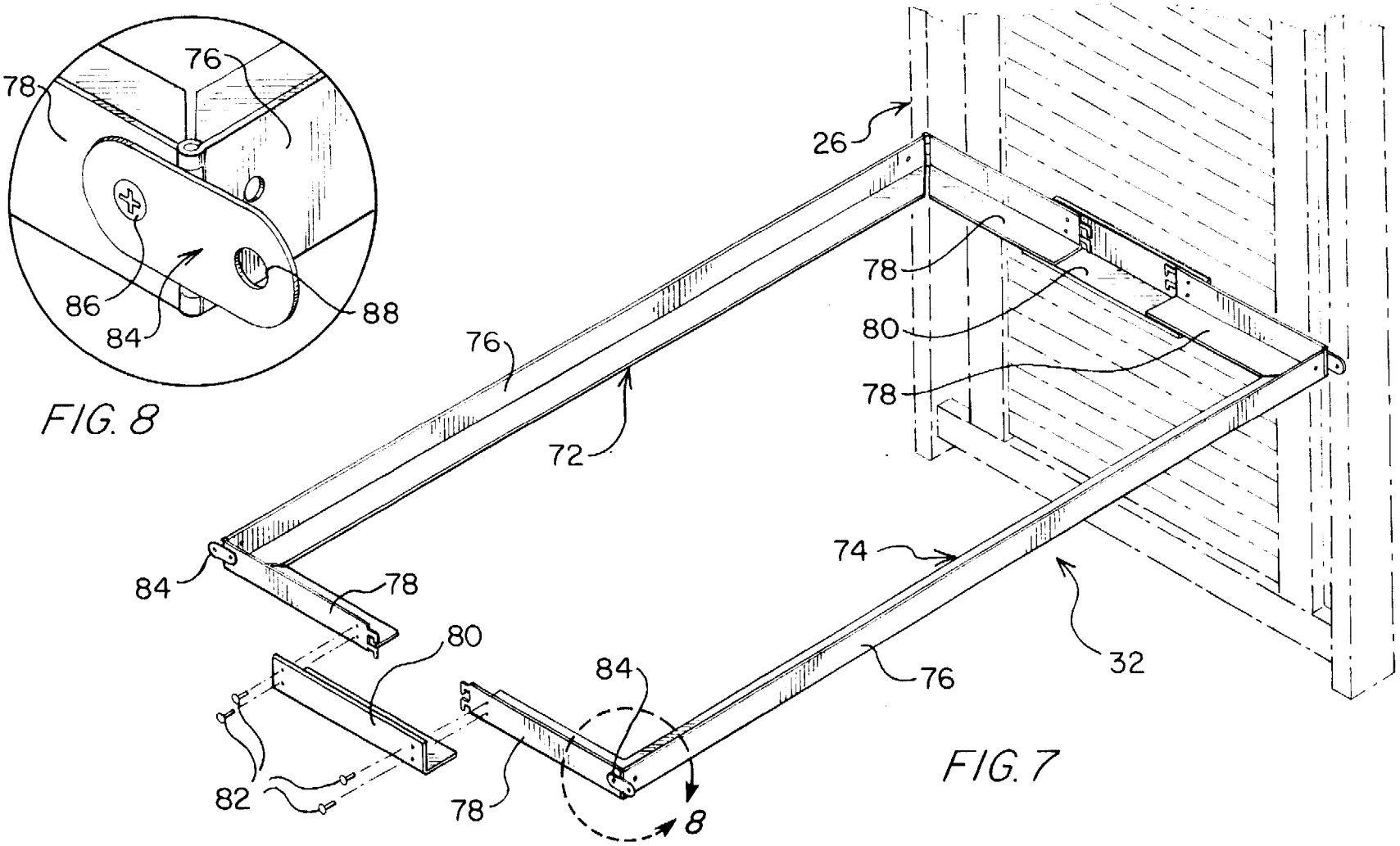
FIG. 7 is a perspective view of the mattress frame assembly of FIG. 1, shown with a connecting frame member exploded therefrom and with the headboard shown in phantom.
FIG. 8 is a close-up view of a corner of the mattress frame assembly of FIG. 7, the view being substantially taken of the area bounded by line 8 of FIG. 7.

The crib mattress frame assembly 32 can best be appreciated in FIGS. 7 and 8. As shown in FIG. 7, the mattress frame assembly 32 includes a left frame assembly 72 and a right frame assembly 74. The left and right frame assemblies 72 and 74 each include a central frame member 76 and a pair of extension frame members 78 pivotably attached via pivot points at opposite ends of the central frame member 76. The left and right frame assemblies 72 and 74 each are L-shaped in cross-section, having a vertical wall and a lower horizontal wall protruding toward the interior of the assembly 32. The left and right frame assemblies 72 and 74 are connected together by a pair of connecting frame members 80. Attachment hardware including bolts 82 is used to connect the connecting frame members 80 to ends of the extension frame members 78. When assembled together in an orientation wherein the extension frame members 78 are positioned at perpendicular angles to the central frame members 76 on each of the assemblies 72 and 74 and the extension frame members 78 are connected together by the connecting frame members 80, the entire crib mattress frame assembly 32 is arranged in the shape of a rectangle as viewed from above. This rectangular shape is suitable for receiving a conventional crib mattress as described above. As the length of the central frame member 76 is approximately fifty-two inches, the total or effective length of each rail assembly 72 and 74 is approximately fifty-two inches, which is well suited to receive a mattress which is fifty-two inches in length.

As can be appreciated in FIG. 8, a tab 84 is connected to each of the extension frame members 78 at the end thereof which is pivotably connected to the central frame member 76. The tab 84 extends peripherally outside of the rectangle generally formed by the crib mattress frame assembly 32 and is suitable for connection to the crib headboard 24 and footboard 28. The tab 84 includes a pair of openings 86 and 88 defined in opposite ends thereof to receive attachment hardware. The opening 86 is employed to affix the tab 84 to the extension frame member 78, while the opening 88 in each tab 84 is employed to attach the crib mattress frame assembly 32 to either the headboard 24 or footboard 28 in a conventional manner.

To convert the crib mattress frame assembly 32 to the twin mattress frame assembly 34, the mattress frame assembly 32 is first removed from the crib headboard 24 and footboard 28. Next, the connecting frame members 80 are disconnected from each of the left and right frame assemblies 72 and 74. Then, the extension frame members are pivoted in the direction of the arrows 90 shown in FIG. 9 to positions where the extension frame members 78 are substantially aligned with and parallel with the central frame members 76 as shown in FIGS. 10 and 11. Once the extension frame members 78 have been placed in these aligned and parallel positions relative to the central frame member 76, the openings 88 and the tabs 84 will be aligned with openings 92 provided in the central frame members 76 for attachment to the tabs 84. Suitable attachment hardware such as the screw 94 shown in FIG. 10 is employed to lock the extension frame members 78 in these aligned positions relative to the central frame member 76. Once the left and right frame assemblies 72 and 74 have been reconfigured into these aligned orientations as represented by frame assemblies 96 and 98, respectively, as shown in FIG. 10, the assemblies 96 and 98 can be attached at opposite ends thereof to the previously described twin headboard 26 and twin footboard 30.

Once configured in the manner shown in FIG. 10, the twin bed configuration 22, and more specifically the twin mattress frame assembly 34, is suitably adapted to receive a conventional box spring and mattress of the twin bed size. The box spring may preferably also be supported by conventional wooden cross-slats. Typically, such mattresses are seventy-four inches in length and thirty-eight inches in width. As the length of the central frame member 76 is approximately fifty-two inches and the length of each of the pair of extension frame members 78 is approximately eleven inches, the total or effective length of each rail assembly 96 and 98 is approximately seventy-four inches. When it is desired to reconfigure the twin bed configuration 22 into the crib bed configuration 20, the steps described above may be reversed.

In addition, any bores 52 in either configuration 20 or 22 which do not contain bolts, are not hidden from view, or are not employed for attaching bed frame assemblies may preferably be covered with wooden plugs (not shown). Also, the mattress support for the crib mattress which is described above may include pockets defined on a bottom side thereof in which hardware to be used only in the twin bed configuration 22 could be stored.

Of course, bolts, screws, and tabs and other means of connecting components and hardware together have been described with some specificity. The exact nature of such connecting hardware is not absolutely vital to the present invention and suitable conventional substitutes for connecting hardware may be employed, including hooks, dowels, nails, latches, etc.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

The invention claimed is:

1. An article of furniture, convertible between a crib bed configuration which is adapted to receive and support a crib mattress and a twin bed configuration which is adapted to receive and support a twin mattress, the article of furniture comprising:

a headboard and a footboard, each including:

an elongated central member;

a first pair of elongated rails, opposite ones of the first pair being attached to opposite ends of the central member; and a second pair of elongated rails, opposite ones of the second pair being removably attached to opposite ends of the first pair of rails;

wherein, when assembled in this manner and with the first pair of rails oriented horizontally and the second pair of rails oriented vertically, the headboard and the footboard are in the crib configuration;

further wherein the longest dimension of the central member is sufficient to allow the second pair of rails on the headboard and the footboard to be removed and the central member and the first pair of rails to be rotated ninety degrees so that the first pair of rails is oriented vertically to place the headboard and the footboard in the twin configuration; and a pair of bed frame assemblies attachable between the headboard and footboard for supporting the mattress.

2. An article of furniture as defined in claim 1, wherein each bed frame assembly includes an elongated central frame member and a pair of extension frame members, one disposed at either end of the central frame member, each extension frame member being pivotably attached at an end thereof to the end of the central frame member to allow each extension frame member to be pivoted between a position where the extension frame member is perpendicular to the central frame member and a position where the extension frame member is parallel to and aligned with the central frame member, wherein when each of the extension frame members is pivoted to the perpendicular position, the effective length of the bed frame assemblies is approximately equal to the length of the crib mattress and when each of the extension frame members is pivoted to the parallel position, the effective length of the bed frame assemblies is approximately equal to the length of the twin mattress.

3. An article of furniture as defined in claim 2, wherein each bed frame assembly includes a pair of tabs affixed thereto, one associated with each of the pivotable connections of the extension frame members to the central frame member so that the tabs can selectively be used to hold the extension frame member in the parallel position.

4. An article of furniture as defined in claim 3, wherein the tabs can be used to attach the bed frame assemblies to the headboard and footboard when the extension frame members are in the perpendicular position.

5. An article of furniture as defined in claim 2, wherein the article of furniture further includes a pair of connector frame members to attach the pair of bed frame assemblies together in the crib configuration.

6. An article of furniture as defined in claim 1, wherein the first set of rails on the headboard and footboard are removably attached to the central member to allow the first set of rails to be removed from the central member and re-installed at a different position on the first set of rails of the headboard and the footboard.

7. An article of furniture as defined in claim 6, wherein the headboard and footboard in the crib configuration also each include a horizontally-disposed decorative rail attached between upper ends of the second pair of rail members in the crib configuration.

8. An article of furniture as defined in claim 7, wherein each of the decorative rails includes two separate members, a longer member and a shorter member, removably attached end to end to each other, and further wherein the longer member from each of the decorative rails can be attached together and employed as a decorative rail in the twin configuration.

9. An article of furniture as defined in claim 6, wherein the article of furniture further includes a pair of extended rail members for use in the twin configuration to be connected to the ends of the first pair of elongated rails of the headboard of the twin configuration, so as to effectively lengthen the first pair of rails.

10. An article of furniture as defined in claim 9, wherein the central member of the headboard can be attached to the lengthened first pair of rails of the headboard at a location higher than the attachment of the central member of the footboard to the first pair of rails of the footboard.

11. An article of furniture as defined in claim 1, wherein the headboard and footboard in the crib configuration also each include a horizontally-disposed decorative rail attached between upper ends of the second pair of rail members in the crib configuration, and wherein each of the decorative rails includes two separate members, a longer member and a shorter member, removably attached end to end to each other, and further wherein the longer member from each of the decorative rails can be attached together and employed as a decorative rail in the twin configuration.

12. An article of furniture as defined in claim 1, wherein the central member includes a pair of elongated rails attached together by spaced apart slats.

13. An article of furniture as defined in claim 1, wherein the first pair and second pair of rails each include a plurality of bores defined therethrough to receive one of a plurality of bolts for attaching the first pair of rails to the central member and the second pair of rails to the first pair of rails.

14. An article of furniture as defined in claim 13, wherein the central member and the first pair of rails include a plurality of openings defined therein to receive one of a plurality of threaded inserts which can selectively matingly engage with one of the plurality of bolts.

15. A method for converting an article of furniture from a crib bed configuration to a twin bed configuration, the article of furniture including a headboard and a footboard, which are connectable to bed frame rails, the method comprising the steps of:

removing the bed frame rails from the headboard and footboard;

rotating the headboard and the footboard ninety degrees; and attaching bed frame rails to the rotated headboard and footboard.

* * * * *